US007707916B2

(12) United States Patent
Pirseyedi

(10) Patent No.: US 7,707,916 B2
(45) Date of Patent: May 4, 2010

(54) ADJUSTABLE SOCKET

(76) Inventor: Alex Parsa Pirseyedi, 641 Kenwood Road, West Vancouver, BC (CA) V7S 1S7

( * ) Notice: Subject to any disclaimer, the term of this patent is extended or adjusted under 35 U.S.C. 154(b) by 75 days.

(21) Appl. No.: 12/112,321

(22) Filed: Apr. 30, 2008

(65) Prior Publication Data

US 2009/0272237 A1 Nov. 5, 2009

(51) Int. Cl.
*B25B 13/18* (2006.01)

(52) U.S. Cl. ..... 81/128; 279/64

(58) Field of Classification Search ..... 81/128; 279/47–50, 52, 56–57, 60–62, 65–66, 70, 279/74, 82, 902, 64, 69
See application file for complete search history.

(56) References Cited

U.S. PATENT DOCUMENTS 1,008,057 A * 11/1911 Peck ..... 279/69
2,582,444 A * 1/1952 Lucht ..... 81/128
3,795,406 A 3/1974 Röhm
4,022,086 A 5/1977 Ramsey
4,112,792 A 9/1978 Guimarin
4,136,588 A 1/1979 Roder
4,277,991 A 7/1981 Stubenrauch
4,366,732 A 1/1983 Schliep
4,374,481 A 2/1983 Brodie
4,378,714 A 4/1983 Colvin
4,385,534 A 5/1983 Nichols
4,520,698 A 6/1985 Martinmaas
4,608,887 A 9/1986 Colvin
4,663,999 A * 5/1987 Colvin ..... 81/128
4,781,084 A 11/1988 Steen et al.
4,813,309 A 3/1989 Kang
4,856,386 A 8/1989 Rodriguez
4,864,901 A 9/1989 le Duc
4,884,480 A * 12/1989 Briese ..... 81/128
4,892,016 A 1/1990 Anderson
4,911,040 A 3/1990 Kim
4,947,713 A * 8/1990 Arnold ..... 81/121.1
5,067,376 A 11/1991 Fosella
5,163,344 A 11/1992 Mathers
5,213,015 A 5/1993 Disston, Jr.
5,218,890 A 6/1993 Christ, Jr.
5,337,634 A 8/1994 Carnesi (Continued)

FOREIGN PATENT DOCUMENTS

CA 800286 12/1968

(Continued)

*Primary Examiner*—D. S Meislin
(74) *Attorney, Agent, or Firm*—Cameron IP

(57) ABSTRACT

An adjustable socket having a housing with a longitudinal axis. A collar is couplable to and movable along the housing. The collar's lower end is bevelled. A plurality of circumferentially spaced apertures extend through the housing. A jaw is mounted in each aperture for slidable, radial movement through the aperture. Each jaw has a flat inward face and a bevelled outward face. The jaws are biased radially outwardly away from the axis. Rotation of the collar around the housing in a first direction forces the collar's bevelled end against the jaws' bevelled faces, forcing the jaws radially inwardly and forcing their inward faces against a fastener located between the inward faces. Rotation of the collar in the opposite direction allows the jaws to be biased radially outwardly to release the fastener.

23 Claims, 18 Drawing Sheets

U.S. PATENT DOCUMENTS

| | | | | |
|---|---|---|---|---|
| 5,375,489 | A | 12/1994 | McClure | |
| 5,540,124 | A | 7/1996 | Srhoj | |
| 5,660,088 | A | 8/1997 | Benson | |
| 5,664,467 | A | 9/1997 | Breeze | |
| 5,740,704 | A | 4/1998 | Payne | |
| 5,768,961 | A | 6/1998 | Frawley | |
| 5,791,209 | A | 8/1998 | Marks | |
| 5,819,607 | A | 10/1998 | Carnesi | |
| 5,918,511 | A | 7/1999 | Sabbaghian et al. | |
| 5,988,023 | A | 11/1999 | Townsend et al. | |
| 5,996,446 | A | 12/1999 | Lee | |
| 6,000,300 | A | 12/1999 | Plamondon | |
| 6,073,522 | A | 6/2000 | Carnesi | |
| 6,134,992 | A | 10/2000 | Perkins | |
| 6,276,241 | B1 * | 8/2001 | Cornog et al. | 81/170 |
| 6,341,544 | B1 | 1/2002 | Falzone | |
| 6,662,689 | B1 | 12/2003 | Voskanyan | |
| 6,945,145 | B1 | 9/2005 | Kesinger | |
| 6,971,284 | B2 | 12/2005 | Owoc | |
| 7,062,996 | B2 | 6/2006 | Johnson | |
| 7,219,581 | B2 | 5/2007 | Tulloch et al. | |
| 7,261,021 | B1 | 8/2007 | Carnesi | |
| 7,290,467 | B2 | 11/2007 | Harker | |
| 7,318,365 | B2 | 1/2008 | Huang | |
| 2006/0042424 | A1 | 3/2006 | Pirseyedi | |
| 2007/0137440 | A1 | 6/2007 | Hwang | |
| 2007/0193418 | A1 * | 8/2007 | Carnesi | 81/128 |
| 2007/0227311 | A1 | 10/2007 | Wang | |

FOREIGN PATENT DOCUMENTS

| | | |
|---|---|---|
| CA | 1118240 | 2/1982 |
| WO | 2006021099 A1 | 3/2006 |

* cited by examiner

ADJUSTABLE SOCKET

TECHNICAL FIELD

This disclosure pertains to an adjustable socket having jaws which are radially displaceable relative to a fastener positioned between the jaws.

BACKGROUND

An adjustable socket can be a convenient alternative to a set of individual fixed-size non-adjustable sockets. A single adjustable socket can be adjusted to fit fasteners (e.g. nuts, bolts, etc) of different sizes, whereas individual fixed-size sockets must be selected from a socket set to fit fasteners of different sizes. Some adjustable sockets can also grip a worn fastener more firmly than a fixed-size socket selected from a socket set. Conversely, an adjustable socket having worn jaws can grip a fastener more firmly than a worn fixed-size socket selected from a socket set.

Desirable attributes of an adjustable socket include compact, simple, inexpensive construction; and the ability to apply and maintain significant force to a fastener without slippage. These attributes are addressed by the adjustable socket disclosed below.

The foregoing examples of the related art and limitations related thereto are intended to be illustrative and not exclusive. Other limitations of the related art will become apparent to those of skill in the art upon a reading of the specification and a study of the drawings.

BRIEF DESCRIPTION OF DRAWINGS

Exemplary embodiments are illustrated in referenced figures of the drawings. It is intended that the embodiments and figures disclosed herein are to be considered illustrative rather than restrictive.

FIGS. 16A-16B showing the jaws fully opened; FIGS. 16C-16D illustrating motion of the adjustable socket to rapidly close the jaws; and FIGS. 16E-16F illustrating motion of the adjustable socket to tighten the jaws.

DESCRIPTION

Figure 1:
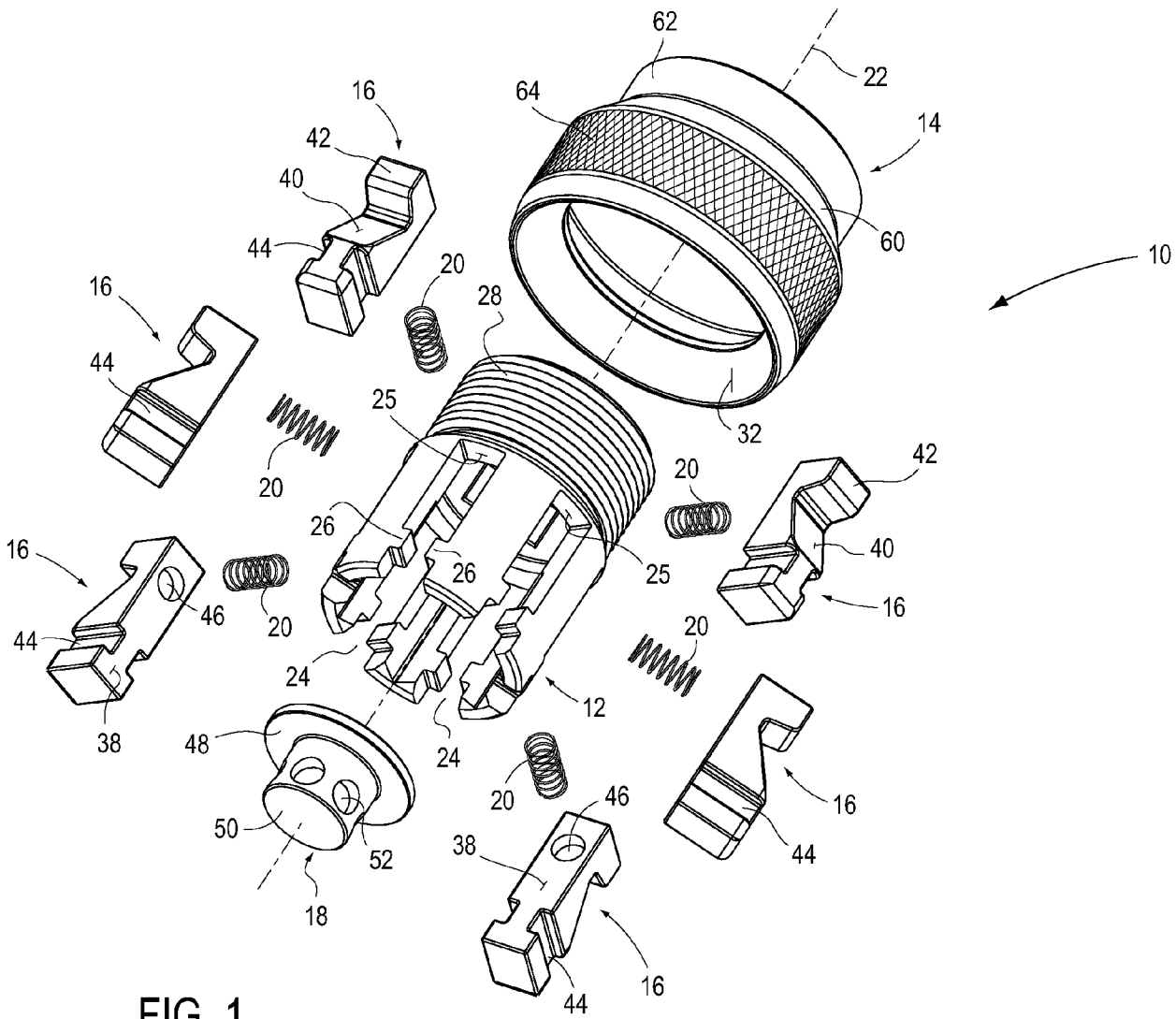
FIG. 1 is an exploded isometric view of an adjustable socket.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

FIGS. 1 and 2A-2D depict an adjustable socket 10 having a housing 12, an adjusting collar 14, a plurality of jaws 16, a retainer 18 and a plurality of biasing members (e.g. springs) 20.

Figure 3A:
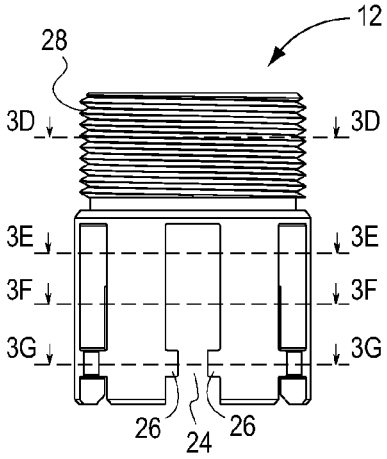
FIGS. 3A, 3B and 3C are respectively front elevation, bottom plan, and oblique bottom views of the FIG. 1 adjustable socket's housing.
Figure 3D:
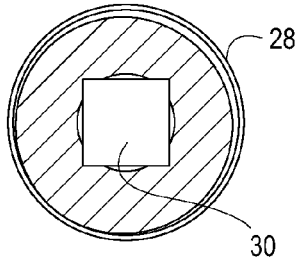
FIGS. 3D, 3E, 3F and 3G are cross-sectional views taken with respect to lines 3D-3D, 3E-3E, 3F-3F and 3G-3G respectively shown in FIG. 3A.
Figure 3B:
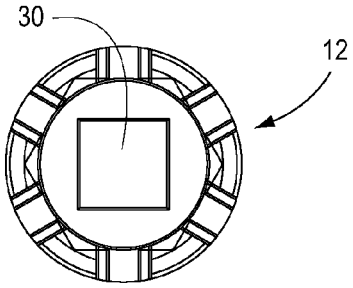
Figure 3E:
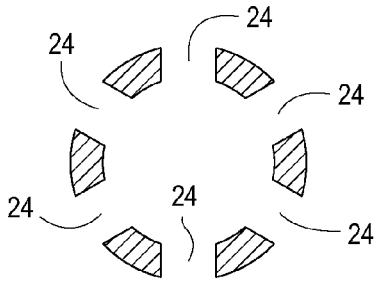
Figure 3F:
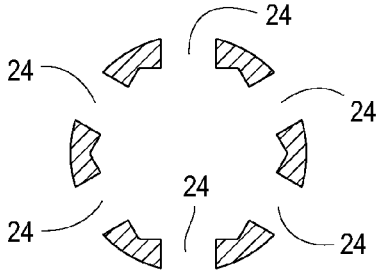
Figure 3C:
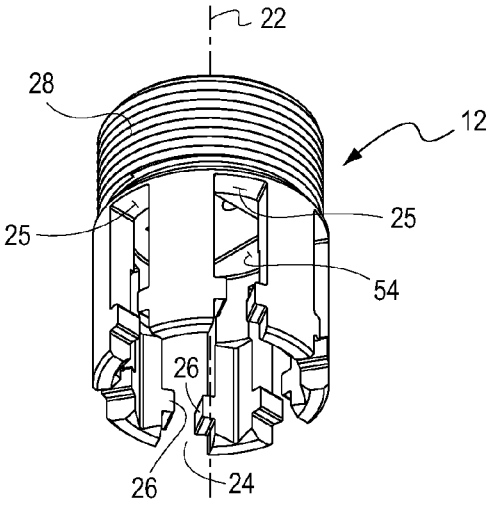
Figure 3G:
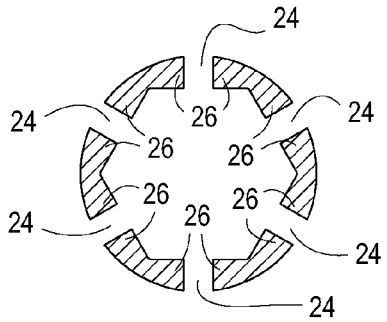
Figure 4A:
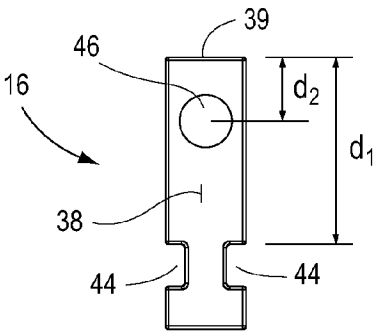
FIGS. 4A, 4B, 4C and 4D are respectively front elevation, side elevation, oblique top front, and oblique top rear views of one the FIG. 1 adjustable socket's jaws.
Figure 4B:
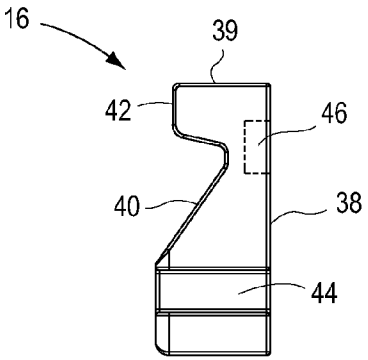
Figure 4C:
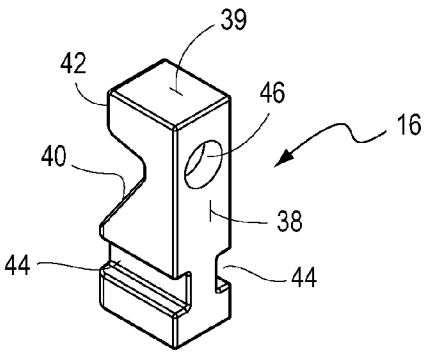
Figure 4D:
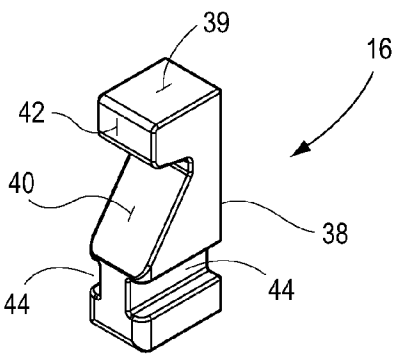
Figure 5C:
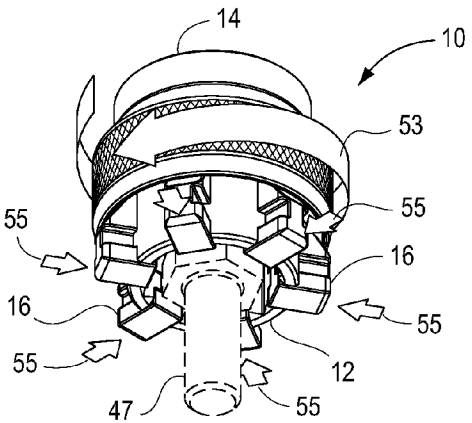
FIGS. 5A, 5B and 5C are respectively cross-sectional front elevation, partial bottom plan and oblique bottom views of the FIG. 1 adjustable socket showing the jaws fully opened, with arrows illustrating motion of the adjustable socket to tighten the jaws on a schematically shown fastener.
Figure 5B:
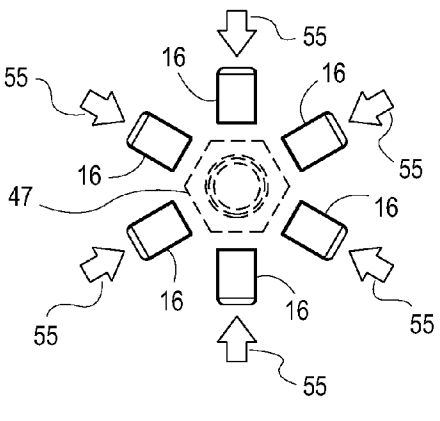
Figure 5A:
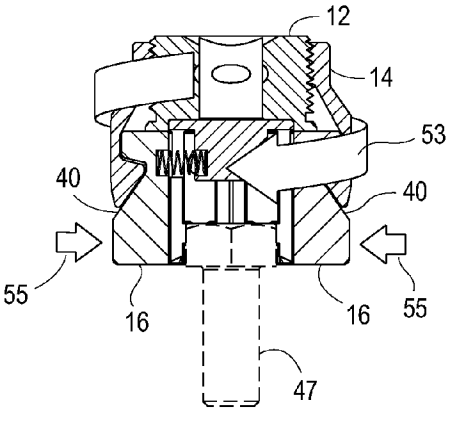
Figure 11A:
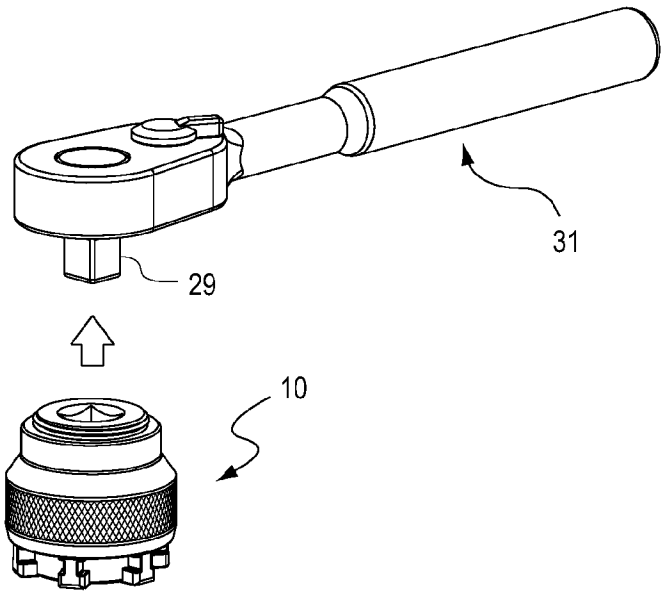
FIGS. 11A, 11B and 11C are respectively oblique top exploded, oblique top and oblique bottom views showing coupling of the FIG. 1 adjustable socket to a ratchet type socket driving implement.
Figure 11B:
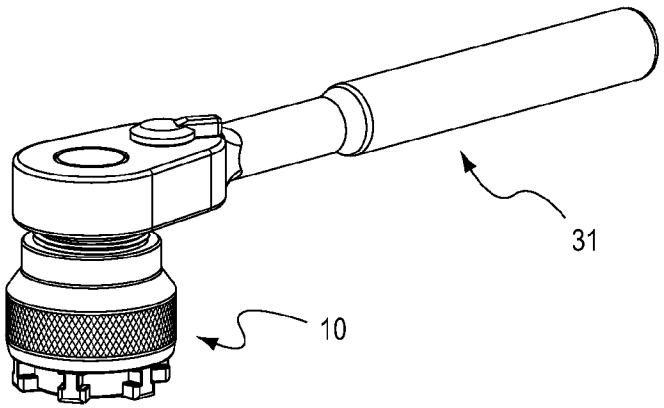
Figure 11C:
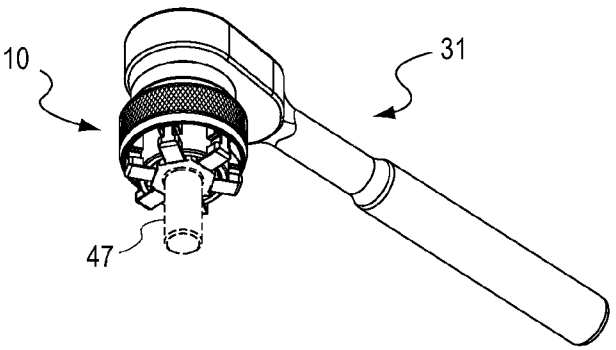
Figure 12A:
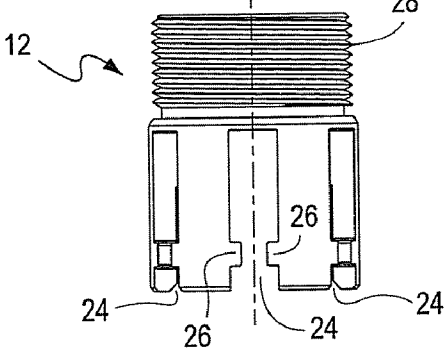
FIGS. 12A and 12B are respectively front elevation and oblique top views of a first housing (also shown in FIGS. 3A-3G)
Figure 12B:
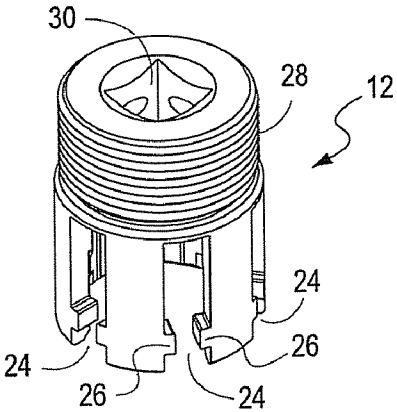
Figure 12C:
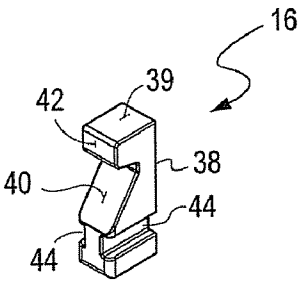
FIGS. 12C and 12D are respectively oblique top rear and oblique top front views of a jaw configured for mating engagement with the first housing.
Figure 12D:
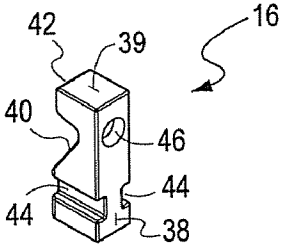

Housing 12 (also shown separately in FIGS. 3A-3C) has a generally cylindrical shape (i.e. is circular in cross-section) and a longitudinal axis 22. A plurality of (e.g. six) equally circumferentially spaced apertures 24 are formed in and extend through the lower end of housing 12. A pair of opposed tongues 26 protrude into the lower end of each one of apertures 24. The upper end of housing 12 is externally threaded, as indicated at 28. A drive aperture 30 is formed in the upper end of housing 12 to removably receive the driving stub 29 of a standard socket driving implement such as ratchet type socket driving wrench 31 as shown in FIGS. 11A-11C. Drive aperture 30 may alternatively removably receive a suitably sized and shaped driving stub mounted on a power-operated drill, power-operated screwdriver, manual screwdriver, etc. Instead of providing drive aperture 30 in housing 12 as aforesaid, one may fix a driving implement such as a handle directly to housing 12 (not shown).

Adjusting collar 14 is circular in cross-section. The lower end of adjusting collar 14 is internally circumferentially bevelled, as indicated at 32 (FIG. 1). A chamber 34 (best seen in FIG. 2B) is formed within adjusting collar 14, above bevelled lower end 32. The upper end of adjusting collar 14 is internally threaded, as indicated at 36, for threadable coupling to housing 12's threaded upper end 28 as explained below.

Each jaw 16 (a single jaw is shown separately in FIGS. 4A-4D) has a flat inward face 38, a flat top face 39, and a bevelled central outward face 40, it being understood that "inward" means facing toward axis 22 and "outward" means facing away from axis 22 as shown in FIG. 1. An outwardly protruding lip 42 is formed at the upper end of each jaw 16, above bevelled face 40. A pair of opposed grooves 44 are formed in the lower end sides of each jaw 16. A recess 46 is formed in the upper end of the inward face 38 of each jaw 16. Adjustable socket 10 may have three pairs of diametrically opposed jaws 16 (i.e. a total of six jaws 16).

Apertures 24, tongues 26, jaws 16 and grooves 44 are sized and shaped for snug fitting of each jaw 16 in a corresponding one of apertures 24 and to permit each jaw 16 to slidably and radially move through the corresponding one of apertures 24, and to resist inward or outward tilting of jaws 16 within apertures 24 relative to axis 22.

The displacement $d_1$ (FIG. 4A) between each jaw's top face 39 and the top of the jaw's grooves 44; the displacement $d_2$ (FIG. 4A) between top face 39 and the centre of the jaw's recess 46; and the wall thickness of housing 12 at each aperture 24; are selected in accordance with well known force balancing principles to avoid self-locking of jaws 16 due to friction when adjustable socket 10 is operated. During such operation (explained below in greater detail) the hexagonal head of fastener 47 (FIG. 1) is gripped between jaws 16, forcing the lower end of the inward face 38 of each jaw 16 against a corresponding one of the outward faces of the hexagonal head of fastener 47. Such forcing tends to tilt the top of each jaw 16 inwardly and tilt the bottom of each jaw 16 outwardly. Each jaw's top face 39 is braced against the top 25 of a corresponding one of housing 12's apertures 24 to resist such tilting, and each jaw's bevelled central outward face 40 is braced against adjusting collar 14's lower end 32 to resist radial outward movement of the jaw during rotation of fastener 47.

Retainer 18 (FIG. 1) has an upper circular flange portion 48. Stud 50 protrudes downwardly from the centre of flange 48. A plurality of equally circumferentially spaced recesses 52 are formed in stud 50.

Figure 2A:
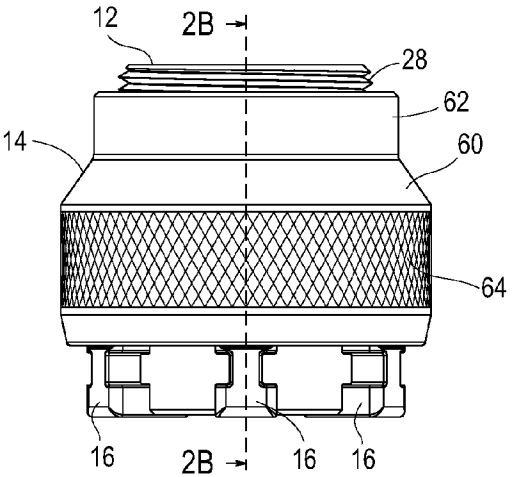
FIG. 2A is a front elevation view of the FIG. 1 adjustable socket.
Figure 2B:
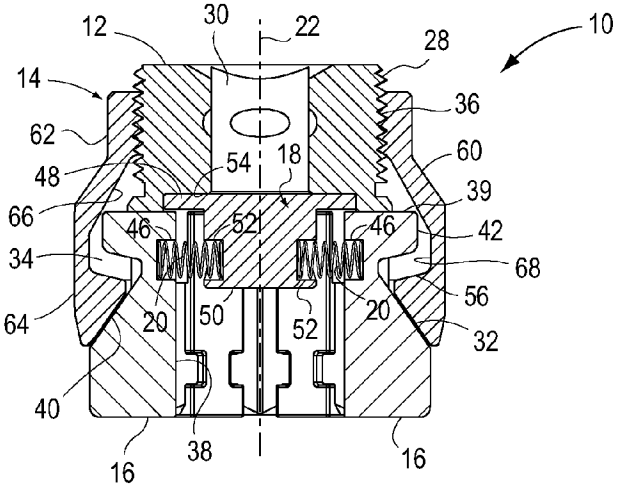
FIG. 2B is a cross-sectional view taken with respect to line 2B-2B shown in FIG. 2A.
Figure 2D:
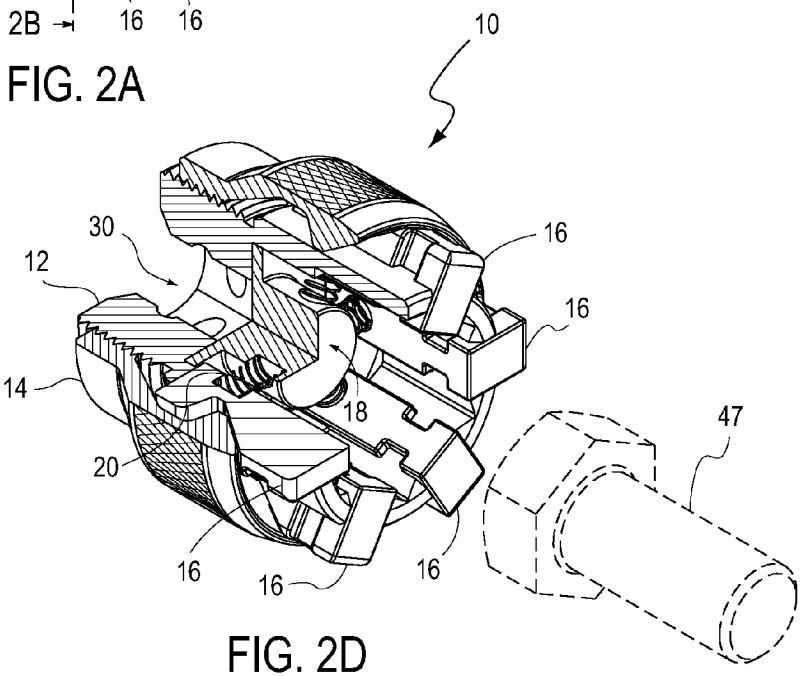
FIG. 2D is an oblique fragmented lower end side view of the FIG. 1 adjustable socket, with a fastener shown schematically.

Adjustable socket 10 is assembled by press-fitting retainer 18 through the lower end of housing 12 until flange 48 contacts inward surface 54 of housing 12 as seen in FIG. 2B. Each jaw 16 is then slidably mounted in a corresponding one of apertures 24, with the jaw's inward face 38 toward axis 22. Each spring 20 is then compressed and fitted between a recess 46 in one of jaws 16 and a corresponding recess 52 in stud 50. A ring clamp (not shown) or the like is used to temporarily compress jaws 16 radially inwardly through apertures 24, toward axis 22. Adjusting collar 14's internally threaded upper end is then threadably coupled to housing 12's threaded upper end 28 and rotated until lips 42 of jaws 16 are within adjusting collar 14's chamber 34. The ring clamp is then removed, allowing springs 20 to bias jaws 16 radially outwardly away from axis 22 until the jaws' bevelled outward faces 40 contact adjusting collar 14's bevelled lower end 32.

Figure 6C:
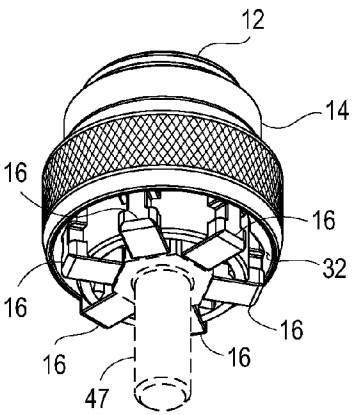
FIGS. 6A, 6B and 6C are respectively cross-sectional front elevation, partial bottom plan and oblique bottom views of the FIG. 1 adjustable socket showing the jaws closed on a schematically shown fastener.
Figure 6B:
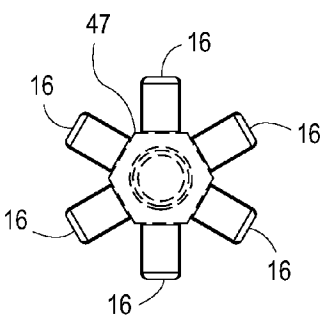
Figure 6A:
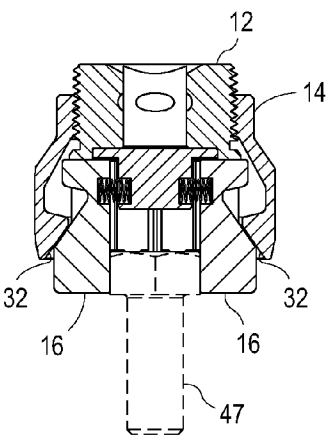

In operation, as shown in FIGS. 5A-5C and 6A-6C, rotation of adjusting collar 14 around housing 12 in a first direction 53 moves adjusting collar 14 downwardly and coaxially along housing 12. This forces adjusting collar 14's bevelled lower end 32 downwardly against the jaws' bevelled outward faces 40, overcoming the biasing force of springs 20 and forcing jaws 16 radially inwardly as indicated by arrows 55. The jaws' inward faces 38 are thus forced against the hexagonal head of fastener 47 (e.g. a bolt or a nut) located between inward faces 38, as shown in FIGS. 6A-6C.

Rotation of adjusting collar 14 around housing 12 in a second direction opposite to first direction 53 moves adjusting collar 14 upwardly and coaxially along housing 12. This allows springs 20 to move jaws 16 radially outwardly toward adjusting collar 14's bevelled lower end 32 (i.e. in directions opposite to those indicated by arrows 55), thereby opening jaws 16 to release fastener 47.

Figure 7D:
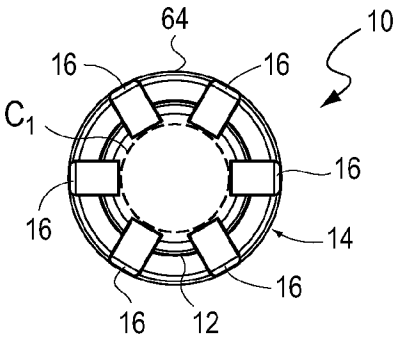
FIGS. 7A, 7B, 7C and 7D are respectively cross-sectional front elevation, oblique top, oblique bottom and partial bottom plan views of the FIG. 1 adjustable socket, showing the jaws in a fully open position.
Figure 7C:
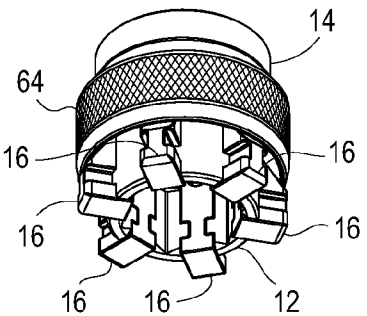
Figure 7B:
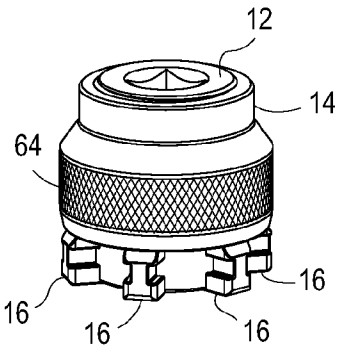
Figure 7A:
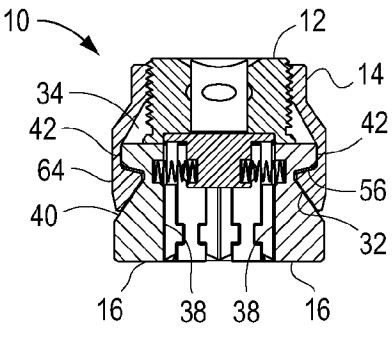
Figure 8D:
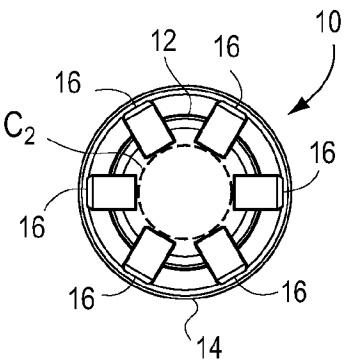
FIGS. 8A, 8B, 8C and 8D are respectively cross-sectional front elevation, oblique top, oblique bottom and partial bottom plan views of the FIG. 1 adjustable socket, showing the jaws in a first partially closed position.
Figure 8C:
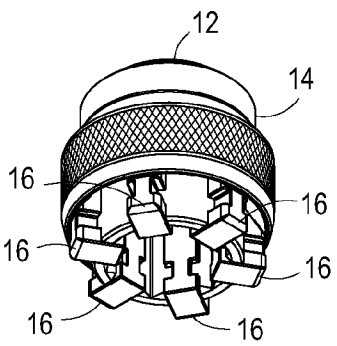
Figure 8B:
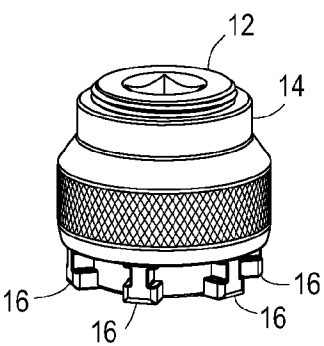
Figure 8A:
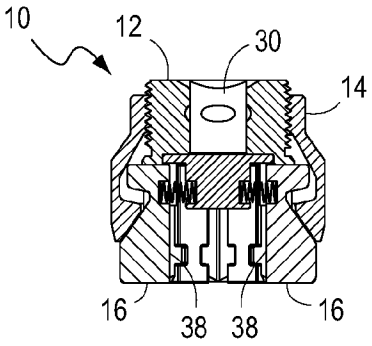
Figure 9D:
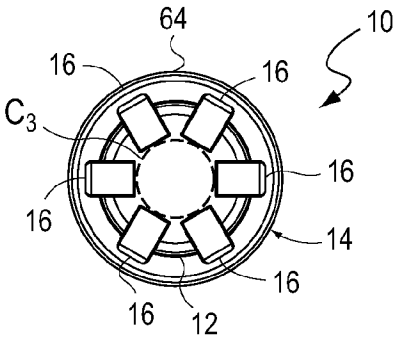
FIGS. 9A, 9B, 9C and 9D are respectively cross-sectional front elevation, oblique top, oblique bottom and partial bottom plan views of the FIG. 1 adjustable socket, showing the jaws in a second partially closed position.
Figure 9C:
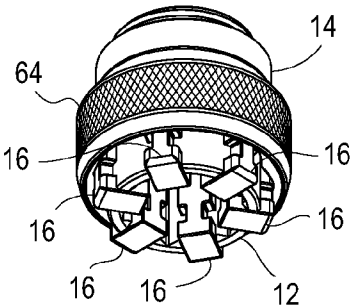
Figure 9B:
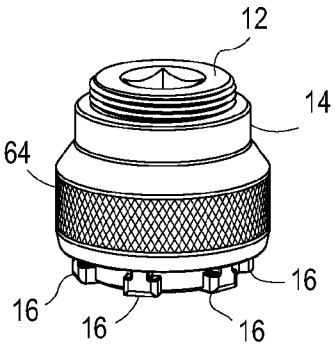
Figure 9A:
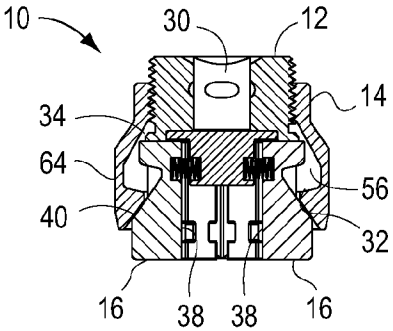
Figure 10D:
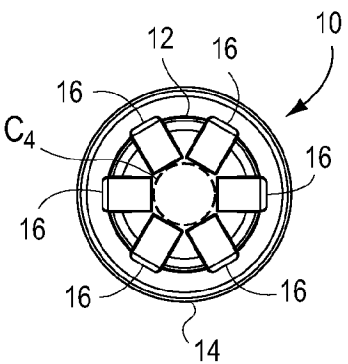
FIGS. 10A, 10B, 10C and 10D are respectively cross-sectional front elevation, oblique top, oblique bottom and partial bottom plan views of the FIG. 1 adjustable socket, showing the jaws in a fully closed position.
Figure 10C:
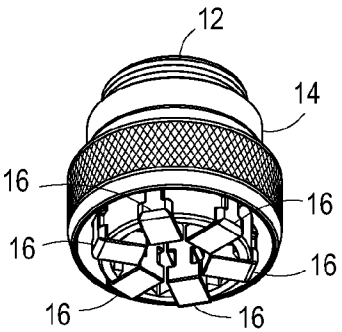
Figure 10B:
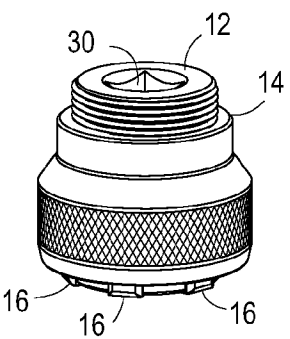
Figure 10A:
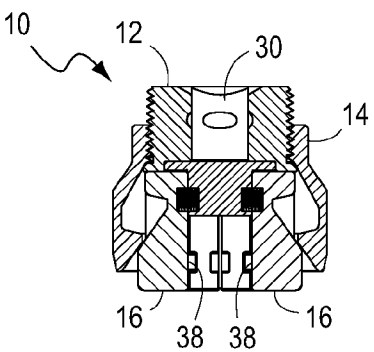

FIGS. 7A-7D show jaws 16 in a fully open position in which the diameter of a notional circle $C_1$ (FIG. 7D) tangential to the jaws' inward faces 38 is maximized. As best seen in FIG. 7A, the outwardly protruding lips 42 of jaws 16 are prevented from moving further downwardly by chamber 34's lower circumferential rim 56, thus retaining jaws 16 within adjustable socket 10.

FIGS. 8A-8D show adjustable socket 10 after rotation of adjusting collar 14 around housing 12 to move jaws 16 into a first partially closed position in which the diameter of a notional circle $C_2$ (FIG. 8D) tangential to the jaws' inward faces 38 is reduced relative to the diameter of notional circle $C_1$.

FIGS. 9A-9D show adjustable socket 10 after further rotation of adjusting collar 14 around housing 12 to move jaws 16 into a second partially closed position in which the diameter of a notional circle $C_3$ (FIG. 9D) tangential to the jaws' inward faces 38 is further reduced relative to the diameter of notional circle $C_2$.

FIGS. 10A-10D show jaws 16 after further rotation of adjusting collar 14 around housing 12 to move jaws 16 into a fully closed position in which the diameter of a notional circle $C_4$ (FIG. 10D) tangential to the jaws' inward faces 38 is minimized.

FIGS. 8A-8D and 9A-9D show just two of many possible partially closed positions. Rotation of adjusting collar 14 around housing 12 facilitates selectable positioning of jaws 16 within a continuously adjustable range of partially closed positions between the fully open position shown in FIGS. 7A-7D and the fully closed position shown in FIGS. 10A-10D.

Comparison of FIGS. 7A-7D, 8A-8D, 9A-9D and 10A-10D reveals that the outwardmost portions of jaws 16 remain within adjustable socket 10's widest external circumference throughout the continuously adjustable range of positions of jaws 16 (i.e. the outwardmost portions of jaws 16 do not extend radially outwardly beyond the external circumference of adjusting collar 14's lower end portion 64). Adjustable socket 10 thus retains the same compact shape whether jaws 16 are fully open, fully closed, or in any intermediate position therebetween.

The inward face 38 of each one of the six jaws 16 makes force transfer contact with a corresponding one of the six outward faces of the hexagonal head of fastener 47. Such force transfer contact is maintained throughout the continuously adjustable range of positions of jaws 16. Rotational driving forces are accordingly equally distributed and applied to each one of the six outward faces of the hexagonal head of fastener 47 throughout the continuously adjustable range of positions of jaws 16.

The flat inward face 38 of each jaw 16 remains parallel to a corresponding one of the six flat outward faces of the hexagonal head of fastener 47 throughout the continuously adjustable range of positions of jaws 16. Accordingly, the inward face 38 of each jaw 16 makes flat surface force transfer contact with a corresponding one of the six outward faces of the hexagonal head of fastener 47. Flat surface force transfer contact is maintained throughout the continuously adjustable range of positions of jaws 16.

FIGS. 12A-12D, 13A-13D, 14A-14D and 15A-15D illustrate different possible configurations of housing 12 and jaws 16, with FIGS. 12A-12D showing the previously described configurations of housing 12 and jaws 16 for purposes of comparison.

Figure 13A:
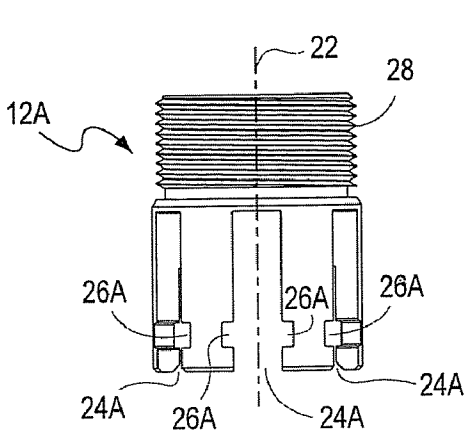
FIGS. 13A and 13B are respectively front elevation and oblique top views of a second housing.
Figure 13B:
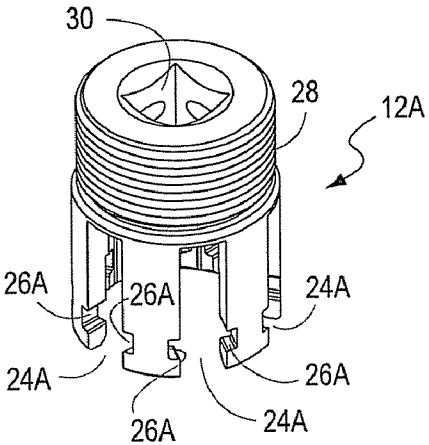

FIGS. 13A-13B depict an alternative housing 12A. Elements which are common to housing 12 and alternative housing 12A bear the same reference numerals in the drawings and need not be described further. Elements which are unique to alternative housing 12A have reference numerals with the suffix "A" in FIGS. 13A-13B. Specifically, a plurality of (e.g. six) equally circumferentially spaced apertures 24A are formed in and extend through the lower end of alternative housing 12A. A pair of opposed grooves 26A are formed in the lower end of each one of apertures 24A.

Figure 13C:
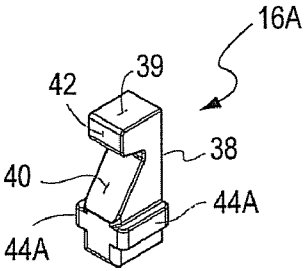
FIGS. 13C and 13D are respectively oblique top rear and oblique top front views of a jaw configured for mating engagement with the second housing.
Figure 13D:
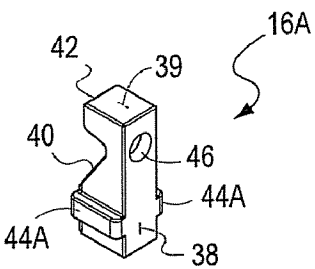

FIGS. 13C-13D depict an alternative jaw 16A. Elements which are common to jaw 16 and alternative jaw 16A bear the same reference numerals in the drawings and need not be described further. Elements which are unique to alternative jaw 16A have reference numerals with the suffix "A" in FIGS. 13C-13D. Specifically, a pair of opposed tongues 44A protrude from the lower end sides of each jaw 16A. Apertures 24A, tongues 44A, jaws 16A and grooves 26A are sized and shaped to permit each jaw 16A to slidably and radially move through a corresponding one of apertures 24A, and to resist inward or outward tilting of jaws 16A within apertures 24A relative to axis 22.

Figure 14A:
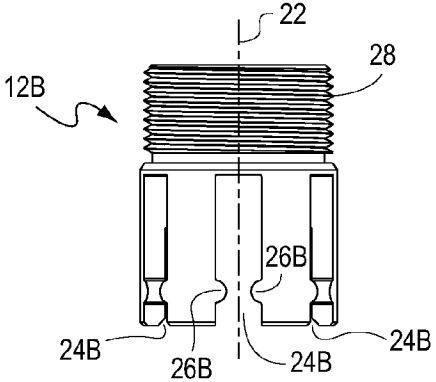
FIGS. 14A and 14B are respectively front elevation and oblique top views of a third housing.
Figure 14B:
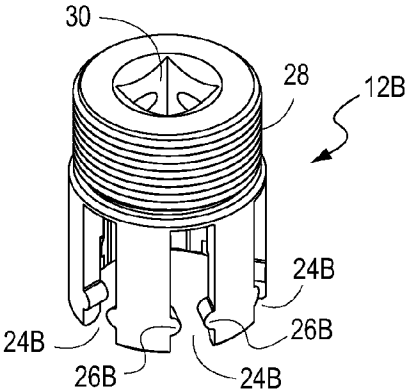

FIGS. 14A-14B depict another alternative housing 12B. Elements which are common to housing 12 and alternative housing 12B bear the same reference numerals in the drawings and need not be described further. Elements which are unique to alternative housing 12B have reference numerals with the suffix "B" in FIGS. 14A-14B. Specifically, a plurality of (e.g. six) equally circumferentially spaced apertures 24B are formed in and extend through the lower end of alternative housing 12B. A pair of opposed tongues 26B protrude into the lower end of each one of apertures 24B. Each tongue 26B has a semi-cylindrical or other rounded shape.

Figure 14C:
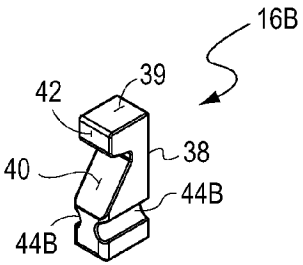
FIGS. 14C and 14D are respectively oblique top rear and oblique top front views of a jaw configured for mating engagement with the third housing.
Figure 14D:
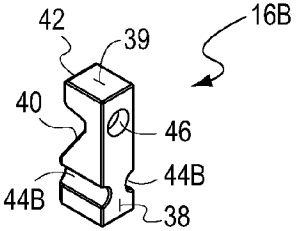

FIGS. 14C-14D depict an alternative jaw 16B. Elements which are common to jaw 16 and alternative jaw 16B bear the same reference numerals in the drawings and need not be described further. Elements which are unique to alternative jaw 16B have reference numerals with the suffix "B" in FIGS. 14C-14D. Specifically, a pair of opposed grooves 44B are formed in the lower end sides of each jaw 16B. Each one of grooves 44B has a semi-cylindrical or other rounded shape matching that of tongues 26B. Apertures 24B, tongues 26B, jaws 16B and grooves 44B are sized and shaped to permit each jaw 16B to slidably and radially move through a corresponding one of apertures 24B, and to resist inward or outward tilting of jaws 16B within apertures 24B relative to axis 22.

It is not essential to provide an opposed pair of tongues or grooves in each of apertures 24, 24A or 24B; nor is it essential to provide an opposed pair of grooves or tongues in each of jaws 16, 16A or 16B. A single tongue or groove in each of apertures 24, 24A or 24B; and a single groove or tongue in each of jaws 16, 16A or 16B will suffice to form a tongue and groove coupling between each one of jaws 16, 16A or 16B and a corresponding one of apertures 24, 24A or 24B.

Figure 15A:
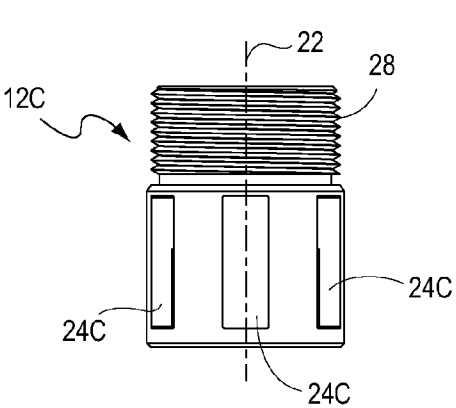
FIGS. 15A and 15B are respectively front elevation and oblique top views of a fourth housing.
Figure 15B:
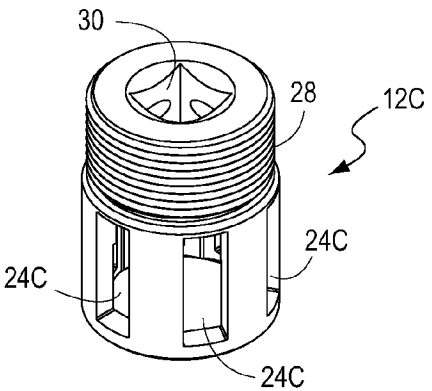

FIGS. 15A-15B depict another alternative housing 12C. Elements which are common to housing 12 and alternative housing 12C bear the same reference numerals in the drawings and need not be described further. Elements which are unique to alternative housing 12C have reference numerals with the suffix "C" in FIGS. 15A-15B. Specifically, a plurality of (e.g. six) equally circumferentially spaced apertures 24C are formed in the lower end of alternative housing 12C. Unlike apertures 24 of housing 12, apertures 24C of housing 12C do not extend through the lower end of alternative housing 12C (i.e. apertures 24C are closed on all sides whereas apertures 24 are open-bottomed). Tongues, grooves, etc. are not provided in apertures 24C, each of which may be rectangular in shape.

Figure 15C:
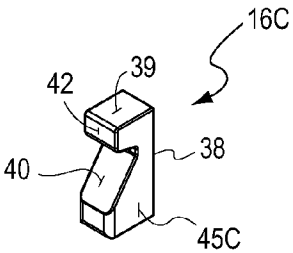
FIGS. 15C and 15D are respectively oblique top rear and oblique top front views of a jaw configured for mating engagement with the fourth housing.
Figure 15D:
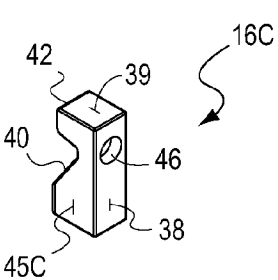
Figure 16E:
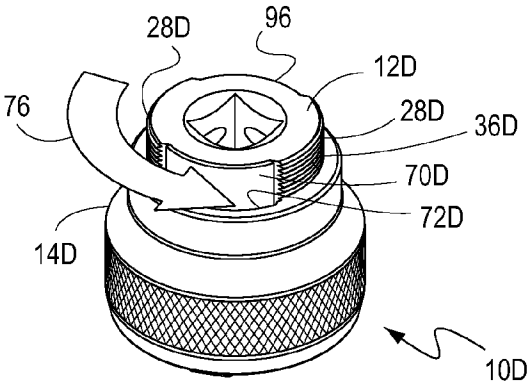
FIGS. 16A-16B, 16C-16D and 16E-16F are respectively pairs of oblique top front and top plan views of an adjustable socket having a rapid jaw closure feature.
Figure 16F:
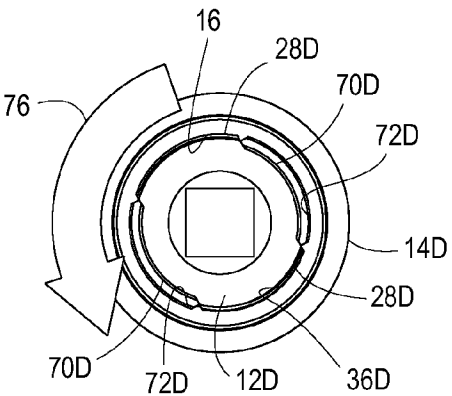
Figure 16C:
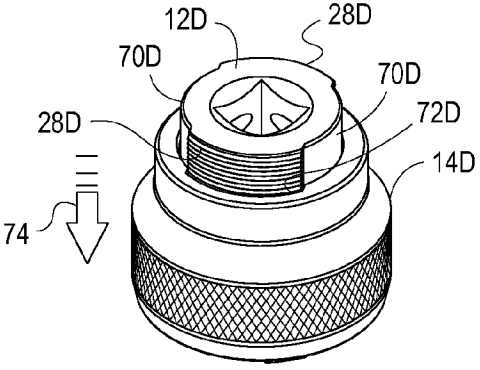
Figure 16D:
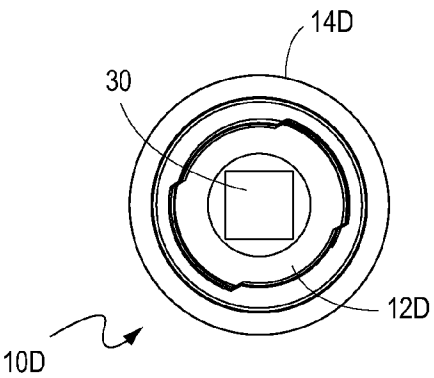
Figure 16A:
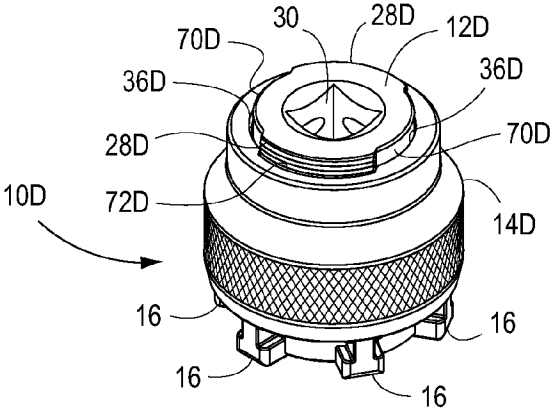
Figure 16B:
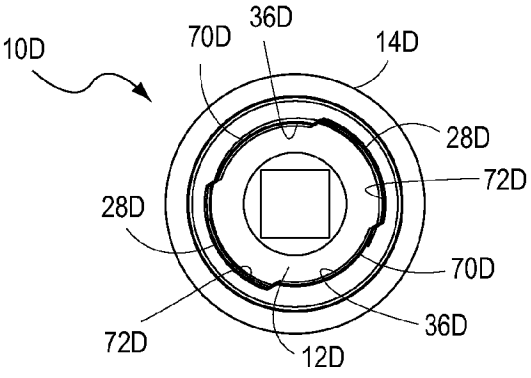

FIGS. 15C-15D depict an alternative jaw 16C. Elements which are common to jaw 16 and alternative jaw 16C bear the same reference numerals in the drawings and need not be described further. Elements which are unique to alternative jaw 16C have reference numerals with the suffix "C" in FIGS. 15C-15D. Specifically, the sides 45C of each jaw 16C are smooth-tongues, grooves, etc. are not provided in jaws 16C.

Each jaw 16C has a rectangular cross-sectional shape matching that of apertures 24C. Apertures 24C and jaws 16C are sized and shaped to permit each jaw 16C to slidably and radially move through a corresponding one of apertures 24C, and to resist inward or outward tilting of jaws 16C within apertures 24C relative to axis 22.

Other aperture and jaw shapes, sizes and configurations capable of permitting each jaw to slidably and radially move through a corresponding housing aperture, and to resist inward or outward tilting of the jaws within the aperture relative to axis 22, will occur to persons skilled in the art.

FIGS. 16A-16F depict an alternative adjustable socket 10D having a rapid jaw closure feature. Elements which are common to adjustable socket 10 and alternative adjustable socket 10D bear the same reference numerals in the drawings and need not be described further. Elements which are unique to alternative adjustable socket 10D have reference numerals with the suffix "D". Housing 12D is similar to housing 12, except that external threads 28D on housing 12D are interrupted by circumferentially spaced, non-threaded regions 70D. Adjusting collar 14D is similar to adjusting collar 14, except that internal threads 36D on adjusting collar 14D are interrupted by circumferentially spaced, non-threaded regions 72D. Externally threaded regions 28D have the same circumferential extent as non-threaded regions 72D, and internally threaded regions 36D have the same circumferential extent as and non-threaded regions 70D. This facilitates alignment of externally threaded regions 28D with non-threaded regions 72D as shown in FIGS. 16A-16D. When externally threaded regions 28D are aligned with non-threaded regions 72D, internally threaded regions 36D are aligned with non-threaded regions 70D, and vice versa. Such alignment allows adjusting collar 14D to be displaced rapidly downwardly and coaxially along housing 12D as indicated by arrow 74 in FIG. 16C, without rotation of either adjusting collar 14D or housing 12D, since externally threaded regions 28D do not engage internally threaded regions 36D. Such rapid downward movement rapidly closes jaws 16. Once jaws 16 have been rapidly closed to a desired extent, adjusting collar 14D is rotated around housing 12D as indicated by arrow 76 in FIGS. 16E-16F. Such rotation threadably engages externally threaded regions 28D with internally threaded regions 36D, allowing incremental tightening of jaws 16 to a desired extent. The aforementioned alignment also allows adjusting collar 14D to be displaced rapidly upwardly and coaxially along housing 12D (i.e. in the direction opposite to that indicated by arrow 74) to rapidly open jaws 16.

Figure 17B:
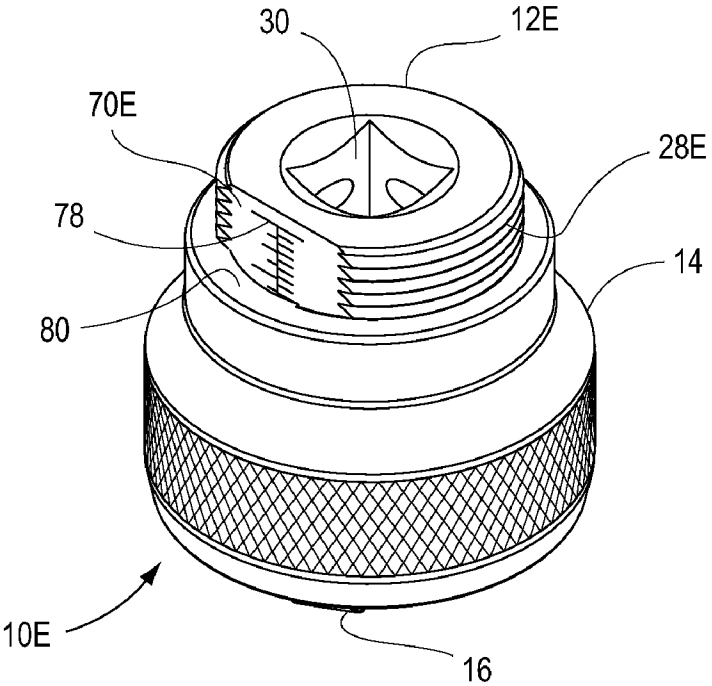
FIGS. 17A and 17B are respectively front elevation and oblique top views of an adjustable socket having a scale to indicate the jaws' position as they are opened or closed.
Figure 17A:
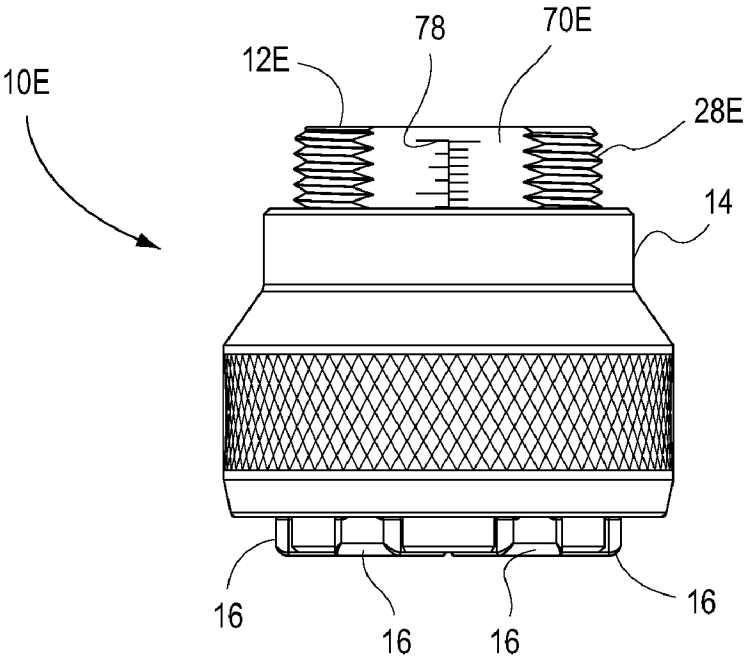

FIGS. 17A-17B depict an alternative adjustable socket 10E. Elements which are common to adjustable socket 10 and alternative adjustable socket 10E bear the same reference numerals in the drawings and need not be described further. Elements which are unique to alternative adjustable socket 10E have reference numerals with the suffix "E". Housing 12E is similar to housing 12, except that external threads 28E on housing 12E are interrupted by non-threaded region 70E which bears a scale 78 calibrated to indicate the position of jaws 16 as the jaws are opened or closed. The jaws' position is indicated by the point at which adjusting collar 14's upper rim 80 intersects scale 78. Suitable calibration markings (not shown) can be provided on scale 78, each marking corresponding to one of a plurality of notional circles tangential to the inward faces 38 of jaws 16 as jaws 16 are opened and closed as aforesaid.

Figure 2C:
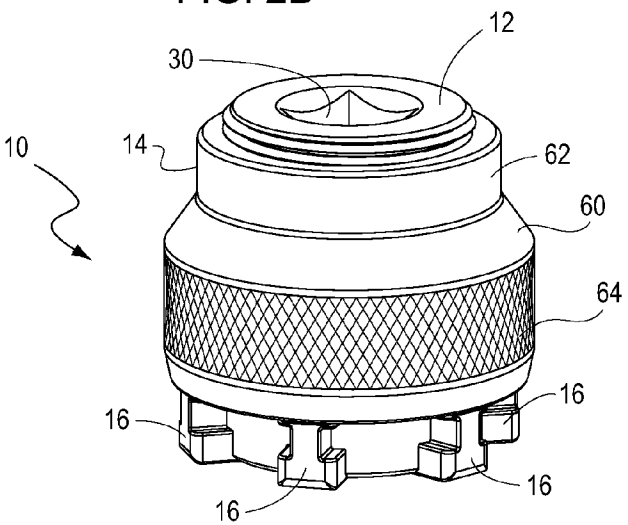
FIG. 2C is an oblique upper front view of the FIG. 1 adjustable socket.
Figure 18A:
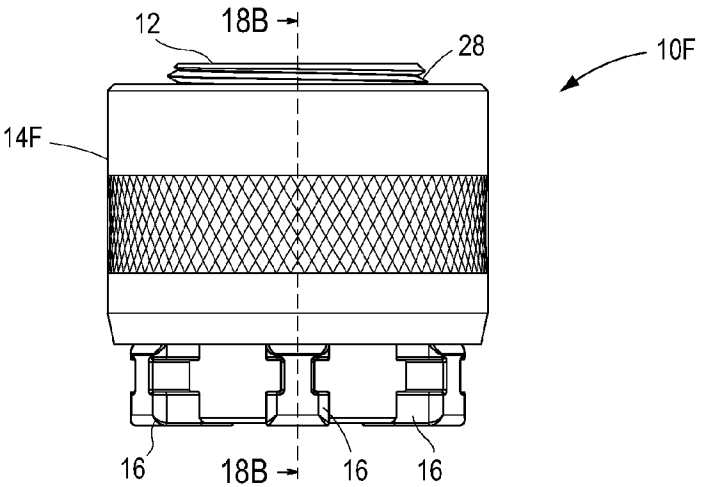
FIGS. 18A, 18B and 18C are respectively front elevation, cross-sectional front elevation (taken with respect to line 18B-18B shown in FIG. 18A) and oblique top views of an adjustable socket having an alternative adjusting collar.
Figure 18B:
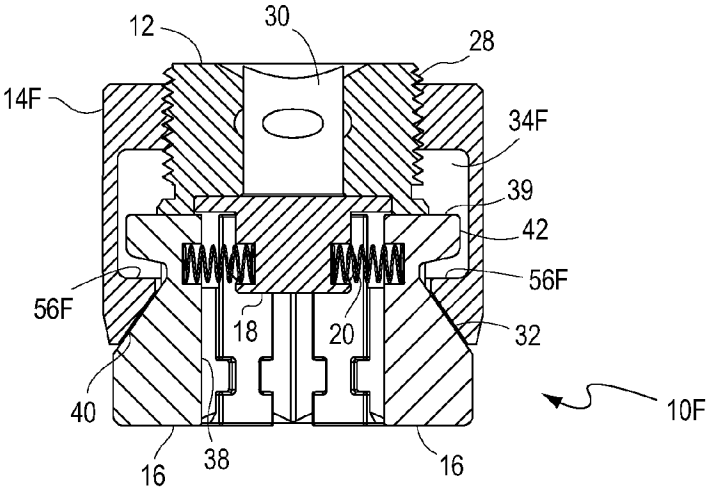
Figure 18C:
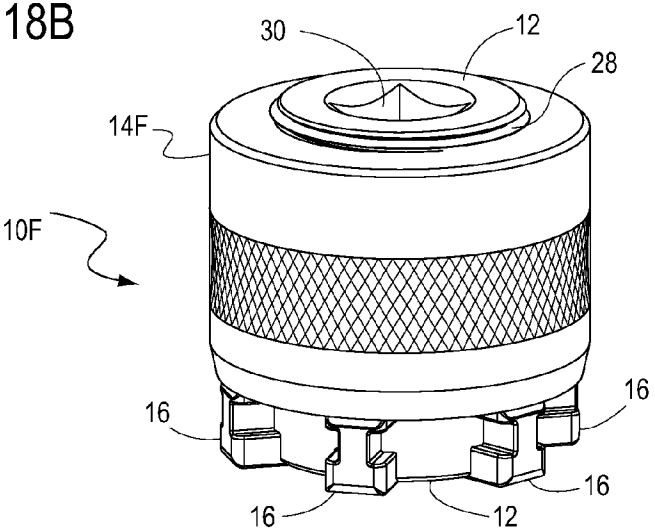

FIGS. 18A-18C depict an alternative adjustable socket 10F. Elements which are common to adjustable socket 10 and alternative adjustable socket 10F bear the same reference numerals in the drawings and need not be described further. Elements which are unique to alternative adjustable socket 10F have reference numerals with the suffix "F". Alternative adjustable socket 10F's adjusting collar 14F has an external cylindrical shape, whereas adjustable socket 10's adjusting collar 14 has a central frusto-conical portion 60 between a reduced-diameter cylindrical upper end portion 62 and an enlarged-diameter cylindrical lower end portion 64 (FIGS. 2A-2C). Internally, chamber 34F within alternative adjustable socket 10F's adjusting collar 14F has a cylindrical shape, whereas chamber 34 within adjustable socket 10's adjusting collar 14 has a frusto-conical portion 66 above a lower cylindrical portion 68. Chamber 34F has a flat lower circumferential rim 56F. These differences give adjustable socket 10 a sleek, compact appearance in comparison to alternative adjustable socket 10F, but they may also complicate and increase the time and cost required to manufacture adjustable socket 10 in comparison to the time and cost required to manufacture alternative adjustable socket 10F.

Figure 19A:
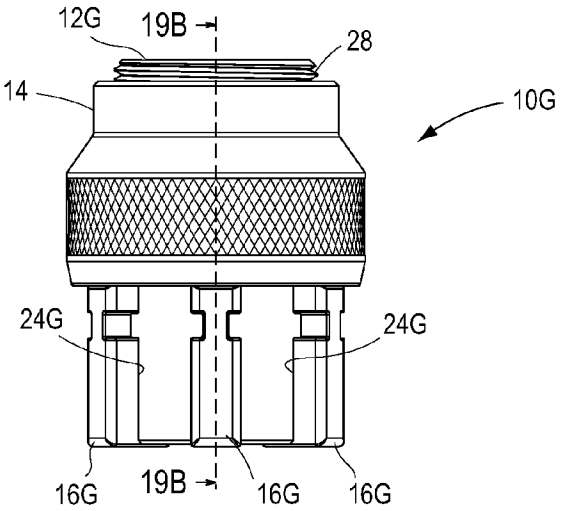
FIGS. 19A, 19B and 19C are respectively front elevation, cross-sectional front elevation (taken with respect to line 19B-19B shown in FIG. 19A) and oblique top views of a "deep" adjustable socket.
Figure 19B:
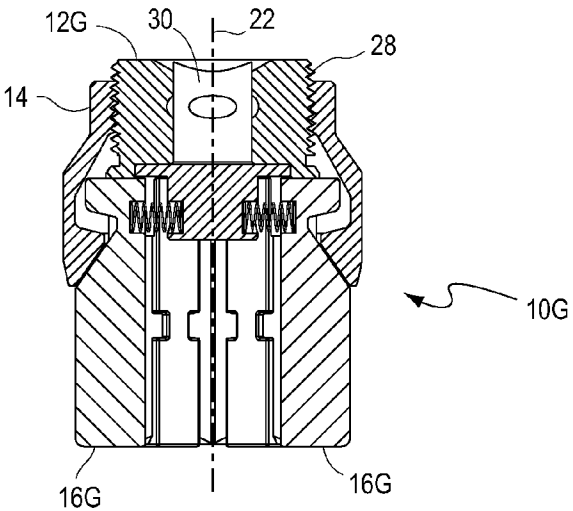
Figure 19C:
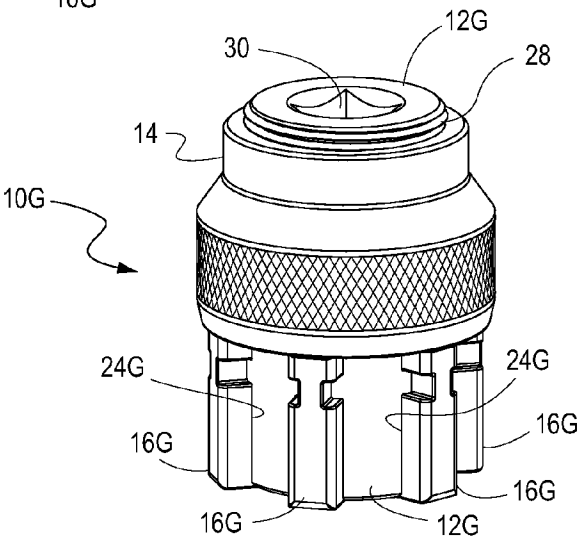

FIGS. 19A-19C depict an alternative "deep" adjustable socket 10G. Elements which are common to adjustable socket 10 and alternative adjustable socket 10G bear the same reference numerals in the drawings and need not be described further. Elements which are unique to alternative adjustable socket 10G have reference numerals with the suffix "G". Alternative adjustable socket 10G's housing 12G is similar to housing 12, except that housing 12G is extended below the lower end of adjusting collar 14, in the direction of longitudinal axis 22. Housing 12G's circumferentially spaced apertures 24G are also extended to accommodate similarly extended jaws 16G. Such extension facilitates insertion of jaws 12G into recesses to grip fasteners which cannot be reached by adjustable socket 10.

Figure 20A:
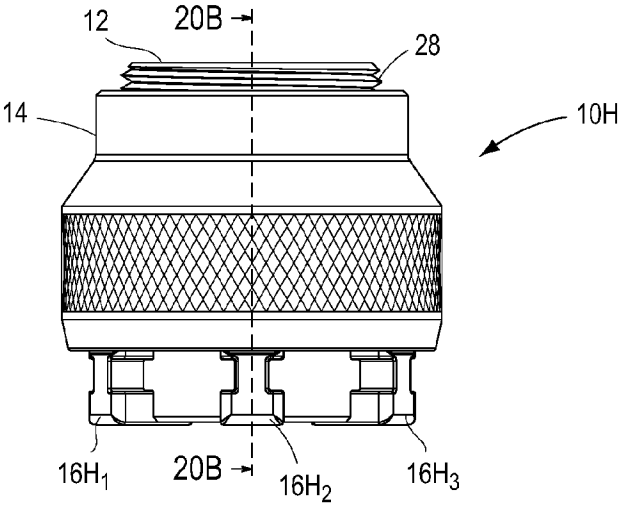
FIGS. 20A and 20B are respectively front elevation and cross-sectional front elevation (taken with respect to line 20B-20B shown in FIG. 20A) views of an adjustable socket having biasing members between diametrically opposed pairs of jaws.
Figure 20B:
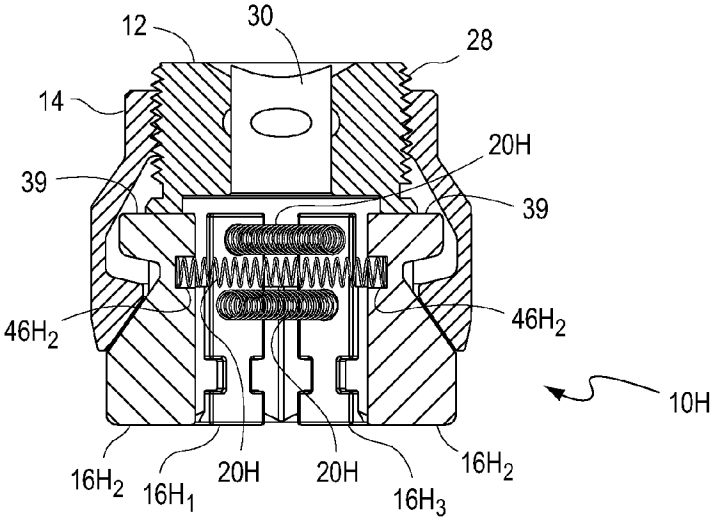
Figure 20D:
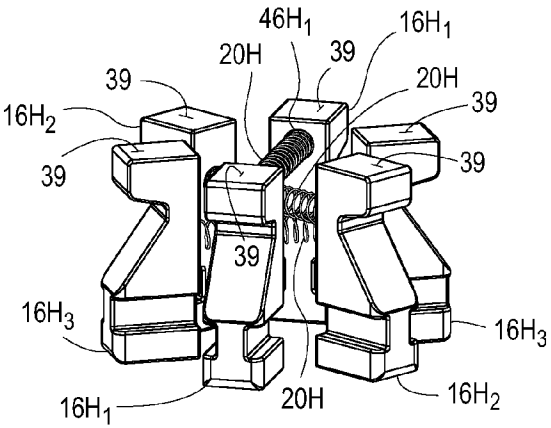
FIG. 20D is an oblique top view of the biasing members and the six jaws.
Figure 20C:
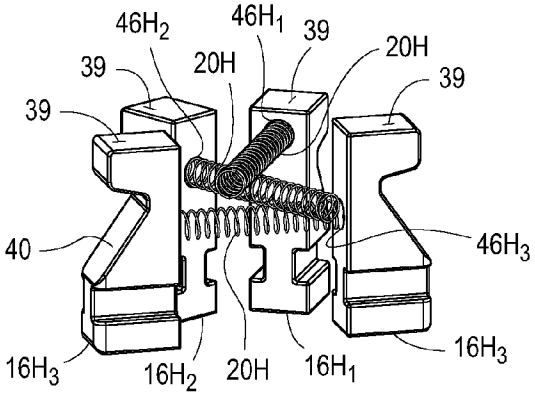
FIG. 20C is an oblique top view of the biasing members and four of the adjustable socket's six jaws.

FIGS. 20A-20B depict an alternative adjustable socket 10H. Elements which are common to adjustable socket 10 and alternative adjustable socket 10H bear the same reference numerals in the drawings and need not be described further. Elements which are unique to alternative adjustable socket 10H have reference numerals with the suffix "H". Instead of having a retainer 18 as described above in relation to adjustable socket 10, alternative adjustable socket 10H has a biasing member (e.g. spring) 20H between each diametrically opposed pair of jaws. If adjustable socket 10H has three pairs of diametrically opposed jaws 16$H_1$, 16$H_2$ and 16$H_3$ (i.e. a total of six jaws, as shown) then three springs 20H are provided. Jaw pair 16$H_1$ is provided with recesses 46$H_1$ which are closer to the jaws' top surfaces 39 than recesses 46$H_2$ provided in jaw pair 16$H_2$. Jaw pair 16$H_3$ is provided with recesses 46$H_3$ which are farther from the jaws' top surfaces 39 than recesses 46$H_2$ provided in jaw pair 16$H_2$. As best seen in FIGS. 20C-20D, such spaced-apart provision of paired recesses 46$H_1$, 46$H_2$ and 46$H_3$ allows a first spring 20H to be fitted between paired recesses 46$H_1$ of opposed jaws 16$H_1$, a second spring 20H to be fitted between paired recesses 46$H_2$ of opposed jaws 16$H_2$, and a third spring 20H to be fitted between paired recesses 46$H_3$ of opposed jaws 16$H_3$. Springs 20H bias jaws 16$H_1$, 16$H_2$, 16$H_3$ radially outwardly away from axis 22 until the jaws' bevelled outward faces 40 contact adjusting collar 14's bevelled lower end 32.

Figure 21C:
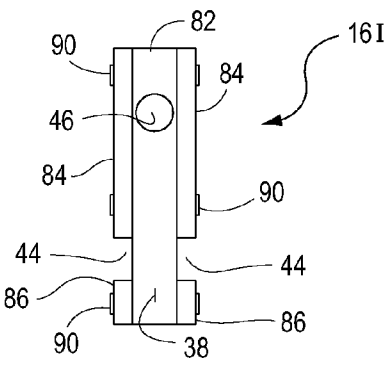
FIGS. 21A, 21B, 21C and 21D are respectively oblique top front, side elevation, front elevation and exploded oblique top front views of a laminated jaw.
Figure 21B:
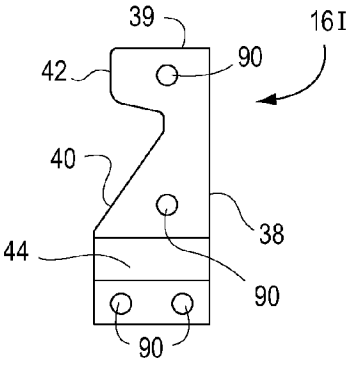
Figure 21A:
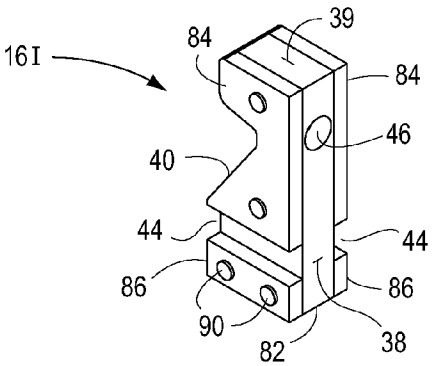
Figure 21D:
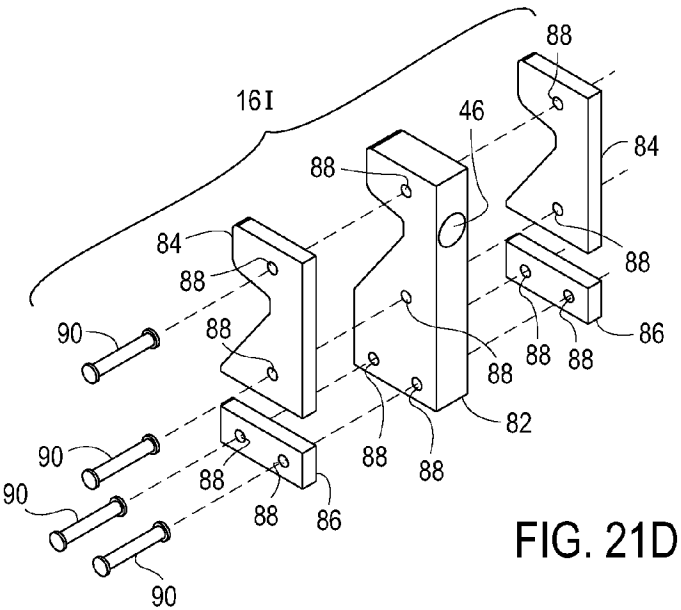

FIGS. 21A-21D depict an alternative "laminated" jaw 16I. Elements which are common to jaw 16 and laminated jaw 16I bear the same reference numerals in the drawings and need not be described further. Laminated jaw 16I incorporates a central layer 82, two opposed upper side layers 84 and two opposed lower side layers 86. Layers 82, 84, 86 are assembled as shown in FIG. 21D by aligning rivet-receiving apertures 88, then fastening rivets 90 through the aligned apertures.

Figure 22:
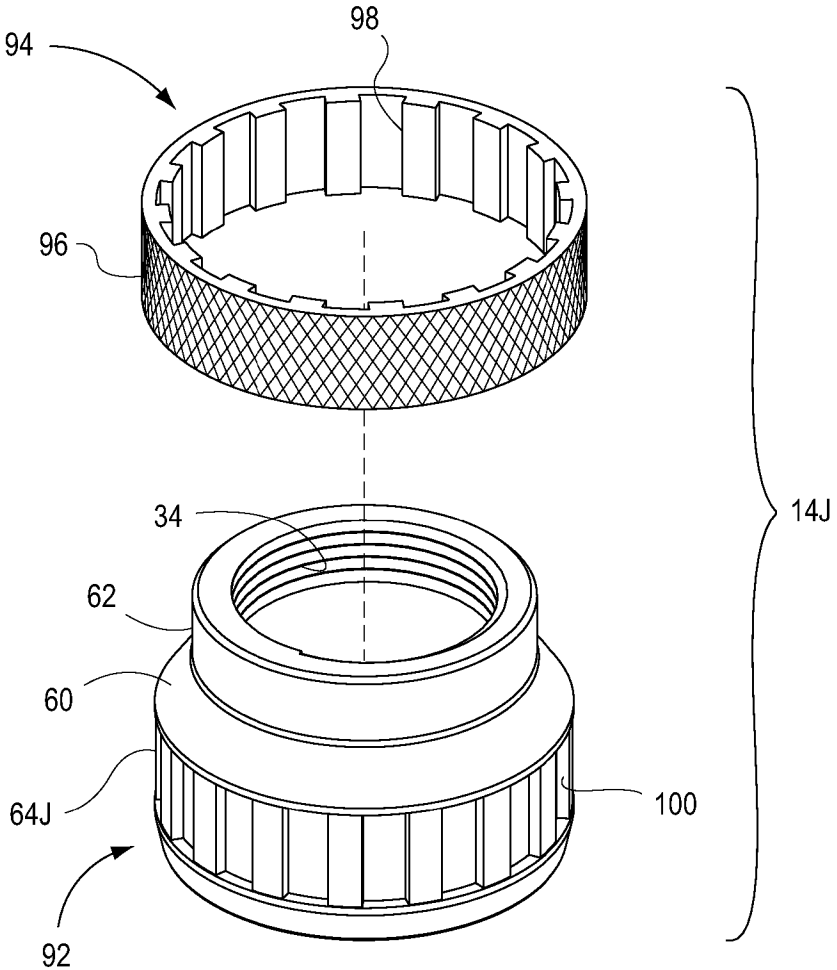
FIG. 22 is an exploded oblique top front view of another alternative adjusting collar.

FIG. 22 depicts an alternative adjusting collar 14J. Elements which are common to adjusting collar 14 and alternative adjusting collar 14J bear the same reference numerals in the drawings and need not be described further. Elements which are unique to alternative adjusting collar 14J have reference numerals with the suffix "J". Adjusting collar 14J is formed in two parts, namely main part 92 and ring 94. Ring 94 may be formed of plastic or similar material. The outer surface 96 of ring 94 may be knurled (as shown) for improved gripping of adjusting collar 14J. Additionally or alternatively, a trademark, trade name, or other indicia may be etched, engraved, or otherwise applied to or formed upon outer surface 96. Ring 94 may have a ribbed inner surface 98 sized and shaped for interlocking engagement with a corresponding ribbed outer surface 100 formed on main part 92. Ring 94 is pressfitted over main part 92 to interlockably engage ribbed surfaces 98, 100 and thereby resist rotation of ring 94 relative to main part 92.

Figure 23C:
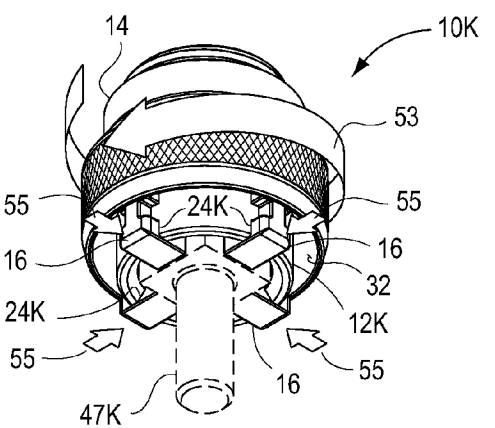
FIGS. 23A, 23B and 23C are respectively bottom plan, partial bottom plan and oblique bottom views of a 4-jaw adjustable socket showing the jaws fully opened, with arrows illustrating motion of the adjustable socket to tighten the jaws on a schematically shown fastener.
Figure 23B:
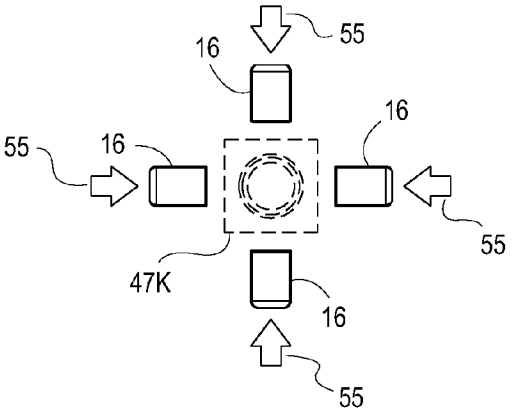
Figure 23A:
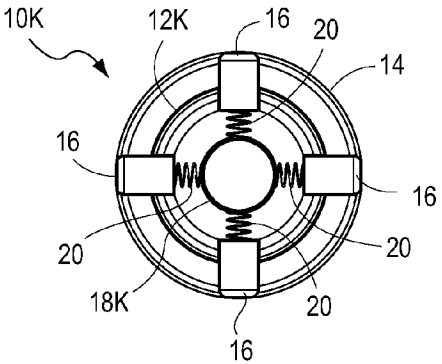

FIGS. 23A-23C depict an alternative, 4-jaw adjustable socket 10K. Elements which are common to adjustable socket 10 and 4-jaw adjustable socket 10K bear the same reference numerals in the drawings and need not be described further. Elements which are unique to alternative adjustable socket 10K have reference numerals with the suffix "K". Housing 12K is similar to housing 12, except that four (instead of six) equally circumferentially spaced jaw-receiving apertures 24K are formed in and extend through the lower end of housing 12K. Retainer 18K is similar to retainer 18, except that four (instead of six) equally circumferentially spaced recesses are formed in retainer 18K's downwardly protruding stud. Adjustable socket 10K has two pairs of diametrically opposed jaws 16 (i.e. a total of four jaws 16). In operation, as shown in FIG. 23C, rotation of adjusting collar 14 around housing 12K in first direction 53 moves adjusting collar 14 downwardly and coaxially along housing 12K. This forces adjusting collar 14's bevelled lower end 32 downwardly against the jaws' bevelled outward faces 40, overcoming the biasing force of springs 20 thus forcing jaws 16 radially inwardly as indicated by arrows 55. The jaws' inward faces 38 are thus forced against the square head of fastener 47K (e.g. a bolt or a nut) located between inward faces 38.

Figure 24C:
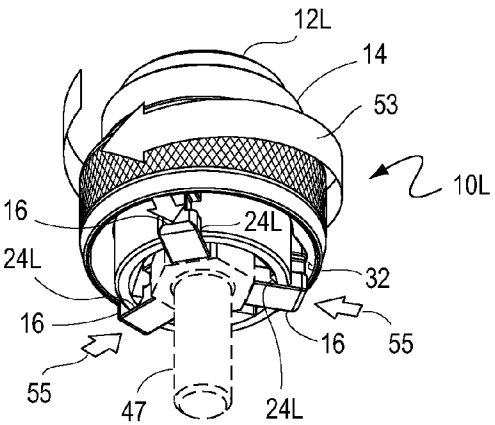
FIGS. 24A, 24B and 24C are respectively bottom plan, partial bottom plan and oblique bottom views of a 3-jaw adjustable socket showing the jaws fully opened, with arrows illustrating motion of the adjustable socket to tighten the jaws on a schematically shown fastener.
Figure 24B:
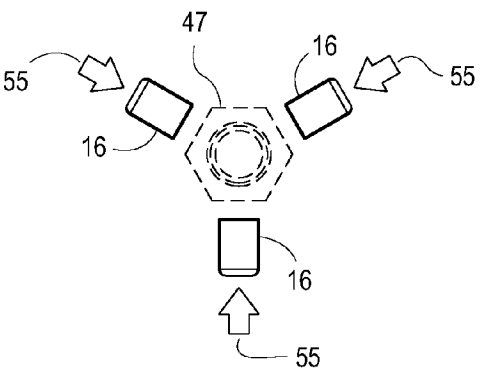
Figure 24A:
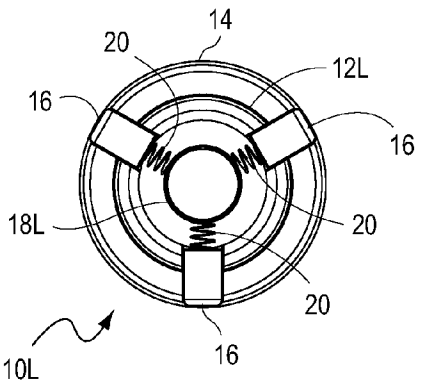

FIGS. 24A-24C depict an alternative, 3-jaw adjustable socket 10L. Elements which are common to adjustable socket 10 and 3-jaw adjustable socket 10L bear the same reference numerals in the drawings and need not be described further. Elements which are unique to alternative adjustable socket 10L have reference numerals with the suffix "L". Housing 12L is similar to housing 12, except that three (instead of six) equally circumferentially spaced jaw-receiving apertures 24L are formed in and extend through the lower end of housing 12L. Retainer 18L is similar to retainer 18, except that three (instead of six) equally circumferentially spaced recesses are formed in retainer 18L's downwardly protruding stud. Adjustable socket 10L has three jaws 16. In operation, as shown in FIG. 24C, rotation of adjusting collar 14 around housing 12L in first direction 53 moves adjusting collar 14 downwardly and coaxially along housing 12L. This forces adjusting collar 14's bevelled lower end 32 downwardly against the jaws' bevelled outward faces 40, overcoming the biasing force of springs 20 thus forcing jaws 16 radially inwardly as indicated by arrows 55. The jaws' inward faces 38 are thus forced against three equally circumferentially spaced ones of the six outward faces of the hexagonal head of fastener 47 (e.g. a bolt or a nut) located between inward faces 38.

While a number of exemplary aspects and embodiments have been discussed above, those of skill in the art will recognize certain modifications, permutations, additions and sub-combinations thereof. For example, external threads 28 on housing 12, and internal threads 36 of adjusting collar 14, may be double-start threads or other types of multiple-start threads to facilitate rapid opening and closing of jaws 16. As another example, a driving implement (not shown) may be removably drivingly coupled to adjusting collar 14 and operated to rotatably drive adjusting collar 14 around housing 12 in order to adjustably position jaws 16. It is therefore intended that the following appended claims and claims hereafter introduced are interpreted to include all such modifications, permutations, additions and sub-combinations as are within their true spirit and scope.

What is claimed is:

1. An adjustable socket having an outermost circumference, the adjustable socket comprising:

a housing having a longitudinal axis;

a plurality of apertures extending through the housing;

an adjusting collar couplable to and movable along the housing, the adjusting collar having a bevelled internal circumferential portion and a chamber adjacent to the bevelled internal circumferential portion;

a plurality of jaws, each jaw being slidably movable through a corresponding one of the apertures, each jaw having:

a flat inward face facing towards the longitudinal axis of the housing;

a bevelled outward face facing away from the longitudinal axis of the housing, the bevelled outward face being slidable on the bevelled internal circumferential portion of the adjusting collar;

an outwardly protruding lip adjacent to the bevelled outward face, the lip protruding into and movable within the chamber; and a biasing element biasing said each jaw away from the longitudinal axis of the housing; and a retainer having a flange supportable by the housing and a protrusion extending from the flange between the jaws' inward faces, each biasing element extending between the protrusion and a corresponding one of the jaws;

wherein the jaws are movable towards and away from the longitudinal axis of the housing through a range of positions; and each of the jaws remains within to outermost circumference of the adjustable socket throughout the range of positions of the jaws.

2. An adjustable socket as defined in claim 1, wherein the bevelled internal circumferential portion of the adjusting collar is at a lower end of the adjusting collar.

3. An adjustable socket as defined in claim 1, further comprising a tongue and groove coupling between each jaw and each corresponding one of the apertures.

4. An adjustable socket as defined in claim 1, wherein:

the housing and the adjusting collar are circular in cross-section; and the adjusting collar is threadably couplable to and rotatable around the housing to move the adjusting collar coaxially along the housing.

5. An adjustable socket as defined in claim 1, further comprising a drive aperture in the housing for removably receiving a driving implement for rotating the housing relative to the adjusting collar.

6. An adjustable socket as defined in claim 1, further comprising a driving implement fixed to the housing for rotating the housing relative to the adjusting collar.

7. An adjustable socket as defined in claim 1, wherein:

rotation of the adjusting collar relative to the housing in a first direction forces the bevelled internal circumferential portion of the adjusting collar against the bevelled outward faces of the jaws, forcing the jaws radially inwardly toward the axis; and rotation of the adjusting collar relative to the housing in a second direction opposite to the first direction enables the biasing elements to move the jaws radially outwardly against the bevelled internal circumferential portion of the adjusting collar.

8. An adjustable socket as defined in claim 1, wherein the apertures are equally circumferentially spaced around the housing.

9. An adjustable socket as defined in claim 1, wherein the adjusting collar is rotatably drivable around the housing to adjustably position the jaws.

10. An adjustable socket as defined in claim 1, further comprising:

threaded and non-threaded regions on the housing; and threaded and non-threaded regions on the adjusting collar;

wherein the threaded regions on the housing are alignable with the non-threaded regions on the adjusting collar, and the threaded regions on the adjusting collar are alignable with the non-threaded regions on the housing to permit non-rotational displacement of the adjusting collar coaxially along the housing.

11. An adjustable socket as defined in claim 1, further comprising a calibration scale on the housing, the scale having a plurality of markings, each marking corresponding to one position within the range of positions of the jaws.

12. An adjustable socket as defined in claim 1, wherein:

the adjusting collar further comprises a ventral frusto-conical portion between a cylindrical upper end portion and a cylindrical lower end portion; and the chamber further comprises a frusto-conical portion above a cylindrical portion.

13. An adjustable socket as defined in claim 1, wherein:

the adjusting collar has an external cylindrical shape; and the chamber has a cylindrical shape.

14. An adjustable socket as defined in claim 1, wherein:

the housing is extended below the lower end of the adjusting collar;

the apertures are extended in the direction of the longitudinal axis; and the jaws are extended for slidable and radial movement of each extended jaw through a corresponding one of the extended apertures.

15. An adjustable socket as defined in claim 1, wherein each biasing element extends between a corresponding diametrically opposed pair of the jaws.

16. An adjustable socket as defined in claim 1, each jaw further comprising:

a central layer;

two opposed upper side layers;

two opposed lower side layers;

a first rivet fastened through the two opposed upper side layers and the central layer; and a second rivet fastened through the two opposed lower side layers and the central layer.

17. An adjustable socket as defined in claim 1, the adjusting collar further comprising a main part and a ring interlockable around the main part.

18. An adjustable socket as defined in claim 1, wherein the jaws are movable through a continuously adjustable range of positions.

19. An adjustable socket as defined in claim 1, wherein, throughout the range of positions of the jaws, rotation of the adjusting collar relative to the housing in a first direction applies force transfer contact between the inward face of each one of the jaws and a corresponding face of a fastener positioned between the jaws.

20. An adjustable socket as defined in claim 1, wherein, throughout the range of positions of the jaws, the flat inward face of each jaw remains parallel to a corresponding face of a fastener positioned between the jaws.

21. An adjustable socket as defined in claim 1, comprising six equally circumferentially spaced apertures and six jaws.

22. An adjustable socket as defined in claim 1, comprising four equally circumferentially spaced apertures and four jaws.

23. An adjustable socket as defined in claim 1, comprising three equally circumferentially spaced apertures and three jaws.

* * * * *